US009144813B2

(12) United States Patent
Kim

(10) Patent No.: US 9,144,813 B2
(45) Date of Patent: Sep. 29, 2015

(54) PUMP-TYPE COSMETICS CONTAINER

(75) Inventor: Sung-Hwan Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 84 days.

(21) Appl. No.: 14/234,866

(22) PCT Filed: Jul. 26, 2012

(86) PCT No.: PCT/KR2012/005952
§ 371 (c)(1),
(2), (4) Date: Jan. 24, 2014

(87) PCT Pub. No.: WO2013/015621
PCT Pub. Date: Jan. 31, 2013

(65) Prior Publication Data

US 2014/0144943 A1 May 29, 2014

(30) Foreign Application Priority Data

Jul. 26, 2011 (KR) ..... 10-2011-0074190

(51) Int. Cl.

| | |
|---|---|
| ***B67B 1/00*** | (2006.01) |
| ***B05B 11/00*** | (2006.01) |
| ***A45D 40/00*** | (2006.01) |
| ***A45D 34/00*** | (2006.01) |

(52) U.S. Cl.
CPC ..... *B05B 11/3059* (2013.01); *A45D 34/00* (2013.01); *A45D 40/00* (2013.01); *B05B 11/0032* (2013.01); *B05B 11/3053* (2013.01); *B05B 11/3097* (2013.01); *B05B 11/0037* (2013.01); *B05B 11/0048* (2013.01); *B05B 11/3023* (2013.01)

(58) Field of Classification Search
CPC ..... B65D 47/30; B65D 47/305; B65D 83/30; B65D 90/58; B65D 90/582; B65D 90/585
USPC ..... 222/153.13, 384, 321.3, 321.2, 222/321.7–321.9, 538, 536, 402.12, 375, 222/380, 153.04, 153.01, 540
See application file for complete search history.

(56) References Cited

U.S. PATENT DOCUMENTS

| | | | | |
|---|---|---|---|---|
| 3,429,483 | A * | 2/1969 | Micallef | 222/153.11 |
| 4,591,079 | A * | 5/1986 | Bigotte | 222/538 |
| 5,390,829 | A * | 2/1995 | Saito et al. | 222/321.8 |
| 5,884,793 | A * | 3/1999 | Wang | 215/389 |
| 6,405,904 | B1 | 6/2002 | Laforcade | |
| 2007/0194050 | A1 * | 8/2007 | Krampen et al. | 222/153.13 |

FOREIGN PATENT DOCUMENTS

| | | |
|---|---|---|
| JP | 2006-282236 | 10/2006 |
| KR | 2004018930000 | 11/2005 |
| KR | 2004134170000 | 4/2006 |

* cited by examiner

*Primary Examiner* — Paul R Durand
*Assistant Examiner* — Andrew P Bainbridge
(74) *Attorney, Agent, or Firm* — IPLA P.A.; James E. Bame

(57) ABSTRACT

A pump-type cosmetics container is not subject to the risk of a foreign substance entering into a nozzle, due to a moving path through which content is discharged during use that is selectively open by means of an opening/closing bracket, and to the risk of change in quality of the content inside the moving path, by means of a counteraction of a control protrusion pressing a locking protrusion thereby re-aspirating the content remaining inside the moving path, after pumping using a double spring.

6 Claims, 5 Drawing Sheets

PUMP-TYPE COSMETICS CONTAINER

BACKGROUND

The present invention relates to a pump-type cosmetics container, and in particular to a pump-type cosmetics container which makes it possible to prevent a foreign substance from entering into a nozzle in such a way that a moving passage through which contents discharge when in use can be selectively open by means of an opening and closing bracket.

A cosmetics container designed to store liquid or gel state cosmetics is equipped with a vacuum pump which is configured to externally discharge an accurate amount of contents which are stored at an injection port.

The above mentioned vacuum pump is manufactured in various structures. According to such vacuum pump, when an operation button installed at the top of a nozzle cap serving to open and close the injection port of the cosmetics container is pressed, vacuum pressure is formed in the interior through a pumping operation, and a certain amount of the contents stored in the container is discharged to the outside through the nozzle by means of the vacuum pressure.

The conventional cosmetics container, in general, is equipped with a vacuum pump, but the storing container is formed in a single structure, so it is hard to maintain a vacuum state in the storing container. For this reason, external air may be inputted into the container or light may transmit through the container, so pumping efficiency becomes bad, and the contents stored in the container may be contaminated or spoiled, the problems of which are based on structural problems.

In order to improve the above listed problems, there is provided a double cosmetics container which has features in that a cosmetic container equipped with a vacuum pump at an injection port of a storing container is made in a double structure consisting of an inner container and an outer container.

As shown in FIG. 5, the conventional cosmetics container configured in a double structure equipped with a vacuum pump is formed of a cosmetic container of a double structure consisting of an inner container 10 storing contents and an outer container 20 which protects the inner container while serving to make the exterior look good.

The vacuum pump 30 has features in that an operation cylinder 31 and a nozzle cap 32 are installed at the injection port of the inner container 10 and at the inner and outer sides in an overlapping structure. At the nozzle cap 32 is disposed an operation button 34 with a nozzle 33 in such a way that the operation button 34 can ascend and descend.

A piston 35 is vertically connected to the bottom of the nozzle cap 32 and ascends and descends in an operation cylinder 31. A piston rest tube 36 is so installed that an orifice can be formed at an inner diameter portion of the piston 35. A valve 37 is provided at an outer surface of the bottom, so the piston can ascend and descend in the operation cylinder 31 for thereby closing and opening a fluid passage. The operation button 34 is elastically installed by means of a return spring 38.

A fluid passage communicating with the inner container 10 is provided in the operation cylinder 31. An opening and closing valve 39 is installed at the fluid passage. The fluid passage can be opened and closed thanks to the vacuum pressure formed through the pumping operation.

According to the thusly configured double cosmetics container, when the operation button 34 is pressed, the return spring 38 is compressed and descends, and the piston 35 and the valve 37 and the piston rest tube 36 all descend by means of the pressing pressure for thereby compressing the space of the operation cylinder 31.

The vacuum pressure of the operation cylinder 31 increases, and the portion between the valve 37 and the piston rest tube 36 opens, and the contents in the operation cylinder 31 is discharged to the outside through the opened gap and through the orifice of the piston rest tube 36 and through the nozzle 33 of the operation button 34.

At this time, the opening and closing valve 39 maintains the fluid passage closed with the aid of the pressure of the operation cylinder 31. On the contrary, when the pressed operation button 34 is released, the piston 35, the valve 37 and the piston rest tube 36 ascend to their original positions by means of the recovering force of the return spring 38. For this operations, a vacuum pressure is formed in the operation cylinder 31, and the opening and closing valve 39 allows the fluid passage to open, so the contents in the inner container 10 flows in the operation cylinder 31 and standbys for the next discharge.

The above described conventional cosmetics container, however, has problems in that since the nozzle always remains exposed, the contents remaining in the interior of the nozzle may be spoiled, which results in a sanitary problem. In addition, the contents may be discharged by means of a pumping by mistakes, so the contents may be consumed unintentionally.

SUMMARY OF THE INVENTION

Accordingly, the present invention is made so as to improve the problems encountered in the conventional art. It is an object of the present invention to provide a pump-type cosmetics container which makes it possible to prevent a foreign substance from entering into a nozzle in such a way that a moving passage through which contents discharge when in use can be selectively open by means of an opening and closing bracket.

It is another object of the present invention to provide a pump-type cosmetics container which makes it possible to prevent any spoilage of contents in a moving passage in such a way to suck back the contents which remain in the interior of the moving passage with the aid of a counteraction formed as a control protrusion pressurizes a locking protrusion after a pumping operation is performed using a double spring.

To achieve the above objects, there is provided a pump-type cosmetics container, comprising a container body 100 which stores contents; a pumping member 200 which pumps out the contents stored in the interior of the container body 100; a locking member 300 which is engaged to the top of the container body 100 and is formed of a hollow part 310 formed in an upward and downward direction so that the contents pumped out by the pumping member 200 to pass through, an operation space 320 formed in an upward and downward direction, and a locking protrusion 330 which protrudes from its top; an intermediate member 400 which is engaged to the top of the locking member 300 and is formed of a moving passage 410 communicating with the hollow part 310 for introducing in the contents pumped out by the pumping member 200, and an external operation bracket 440 which is inserted into the operation space 320 and ascends and descends; and an opening and closing bracket 500 which is engaged to the top of the intermediate ember 400 and is rotatable and is formed of a control protrusion 520 which is disposed at the bottom and contacts with the locking protrusion 330 and allows a selective movement of the intermediate part 400 in an upward and downward direction.

In addition, there is further provided a button 600 including a protrusion part 610 which covers the top of the intermediate member 400 and is operable in an upward and downward direction when the opening and closing bracket 500 rotates, and the control protrusion 520 separates from the locking member 330 for thereby covering the top of the end portion of the moving passage 410.

In addition, the locking protrusion 330 comprises a sunk part 331 sunk at the top enough for the control protrusion 520 to be fixedly inserted.

In addition, there are provided a cover 110 which is engaged to the top of the container body 100 and seals the container body 100 and includes a first space 111 in the center of which is installed the pumping member 200; a second space 112 which is formed at an outer side of the first space 111 and comes into contact with the bottom of a lower spring S1; and a third space 113 which is provided at an outer side of the second space 112 and covers an exterior of the operation space 320; a sealing bracket 700 which is inserted into the second space 112 in order for the pumping member 200 to be sealed while covering the exterior of the pumping member 200, so its inner wall can be elastically supported by the top of the lower spring S1, the sealing bracket 700 including a communicating hole 710 communicating with the moving passage 410 and the hollow part 310, and an engaging shoulder 711 disposed in the interior of the communicating hole; an internal operation bracket 450 which protrudes downward from the inner side surface of the intermediate member 400 and passes through the hollow part 310 and is inserted into the communicating hole 710 and moves the sealing bracket 500 downward when it comes into contact with the engaging shoulder 711; and an upper spring S2 which is engaged to an outer surface of the internal operation bracket 450, the bottom of the upper spring S2 being supported by the top of the sealing bracket 700, the top of the same being supported by the inner wall of the intermediate member 400.

In addition, there are further provided a rotation space 420 which is formed on the top of the intermediate member; a rotation groove 430 which communicates with the rotation space 420 and into which the control protrusion 520 is inserted and is rotatable; and a rotary shaft 510 which is inserted into the rotation space 420 and is rotatable in a state that it is connected with the control protrusion 520.

In addition, the opening and closing bracket 500 comprises an opening and closing part 530 which selectively opens and closes the end portion of the moving passage 410 when it rotates by means of the rotary shaft 510.

According to the present invention, the pump-type cosmetics container makes it possible to prevent a foreign substance from entering into a nozzle in such a way that a moving passage through which contents discharge when in use can be selectively open by means of an opening and closing bracket.

In addition, the pump-type cosmetics container makes it possible to prevent any spoilage of contents in a moving passage in such a way to suck back the contents which remain in the interior of the moving passage with the aid of a counteraction formed as a control protrusion pressurizes a locking protrusion after a pumping operation is performed using a double spring.

DETAILED DESCRIPTION OF THE INVENTION

Figure 1:
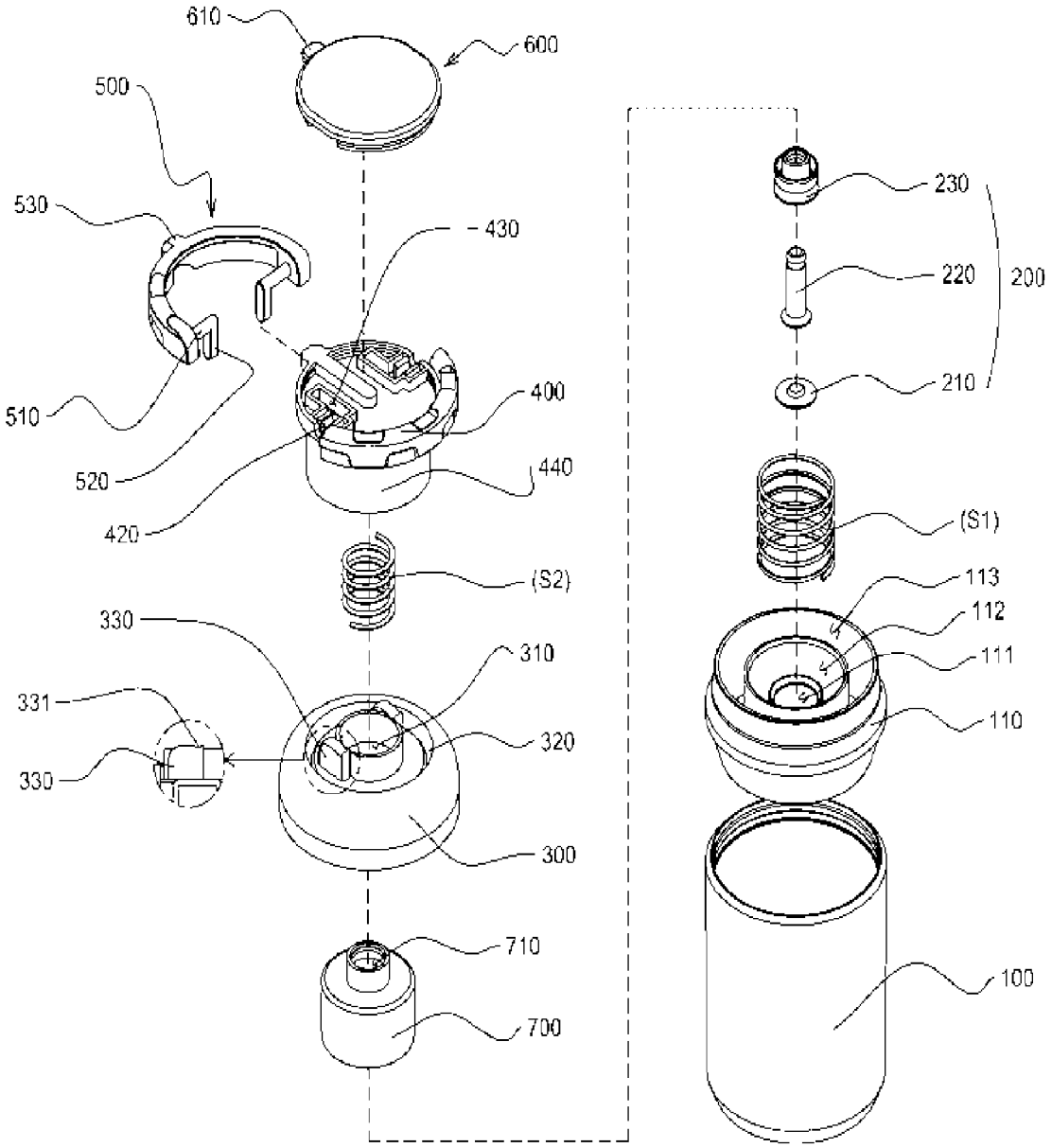
FIG. 1 is a disassembled perspective view illustrating a pump-type cosmetics container according to a preferred embodiment of the present invention.

The preferred embodiments of the present invention will be described with reference to the accompanying drawings. The reference numerals shown in each drawing mean the same elements. The descriptions on the known construction or function in the middle of the description of the present invention will be omitted so as not to make ambiguous the subject matters of the present invention.

Figure 2:
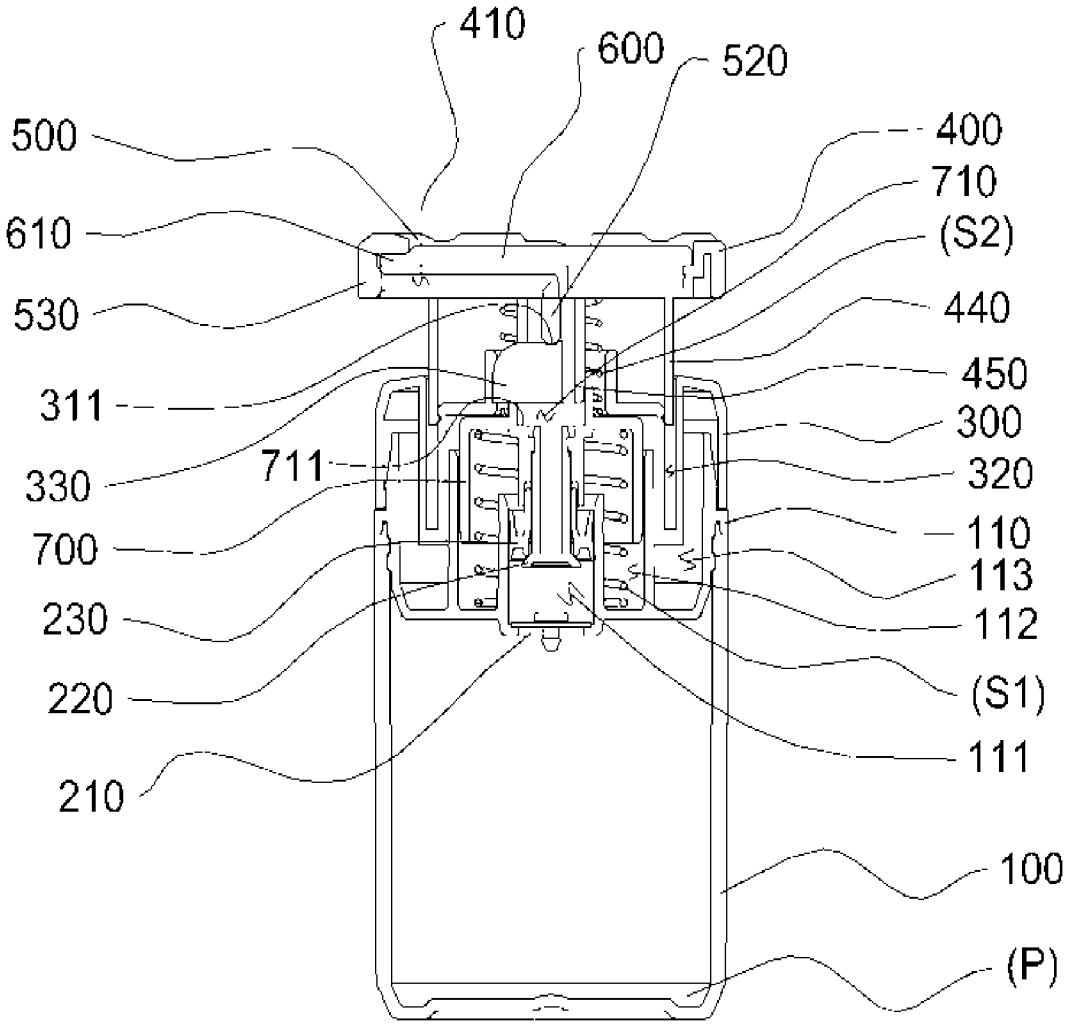
FIG. 2 is a cross sectional view illustrating an initial state of a pump-type cosmetics container according to a preferred embodiment of the present invention.
Figure 3:
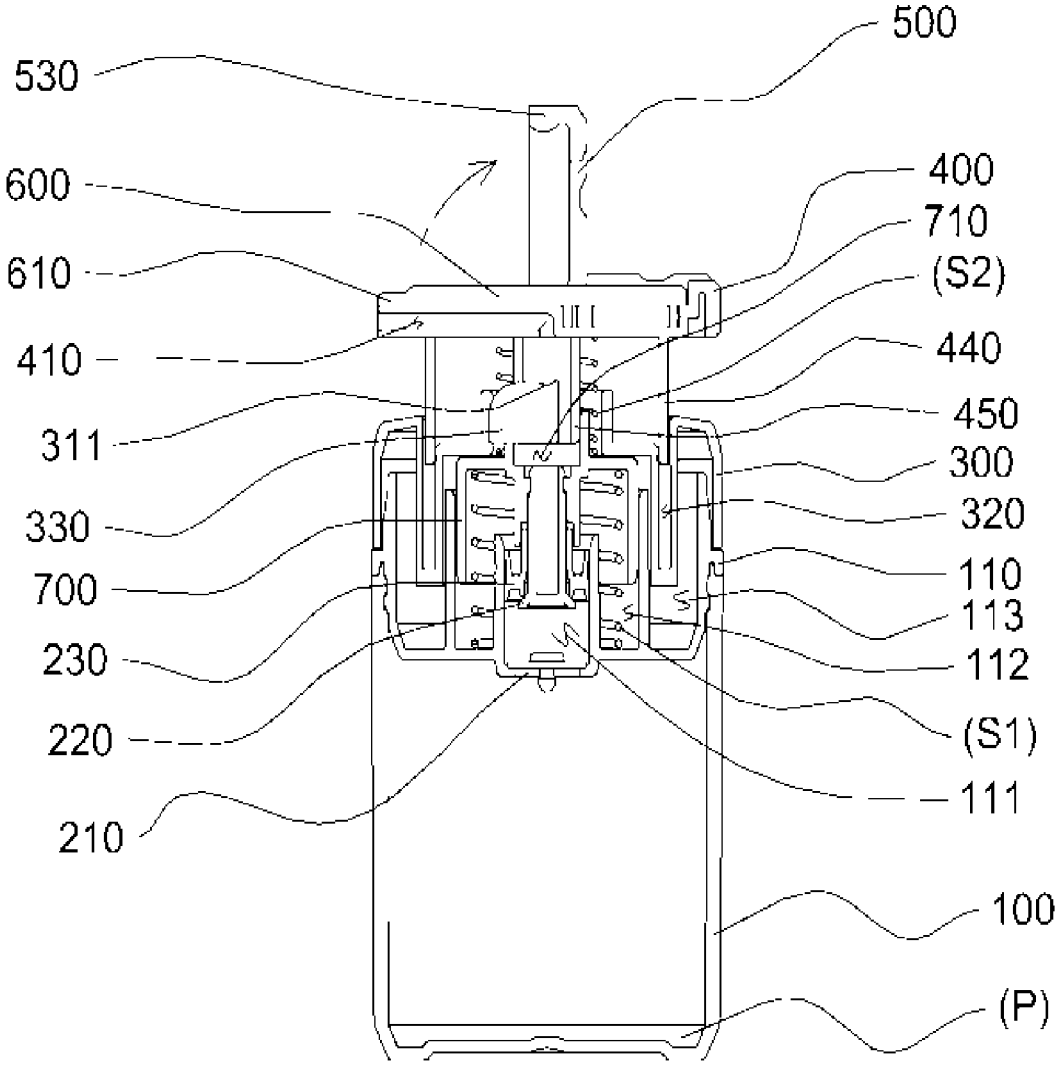
FIG. 3 is a cross sectional view illustrating a state that an end portion of a passing passage is opened as an opening and closing bracket of a pump-type cosmetic container opens according to a preferred embodiment of the present invention.
Figure 4:
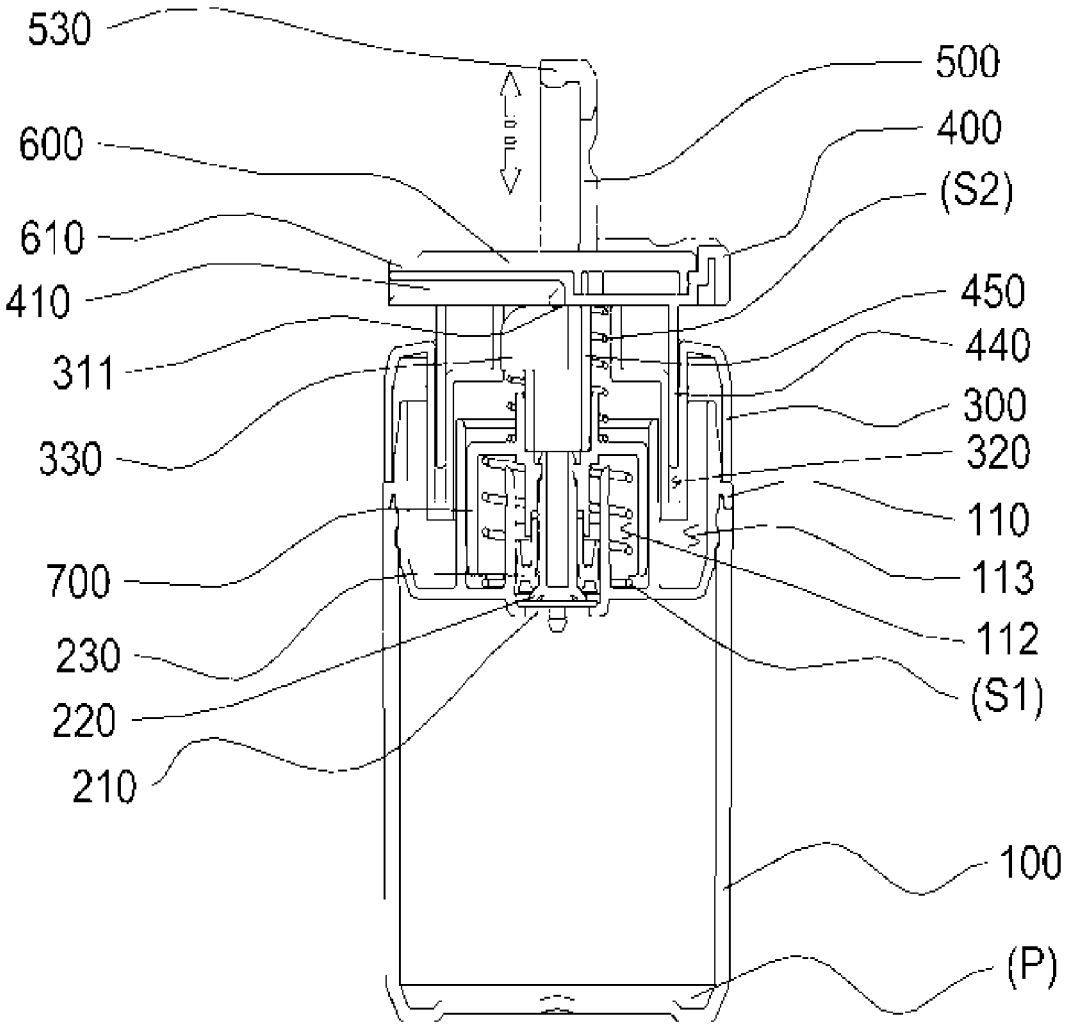
FIG. 4 is a cross sectional view illustrating a state that a content is pumped out as a button of a pump-type cosmetics container is pressurized according to a preferred embodiment of the present invention.
Figure 5:
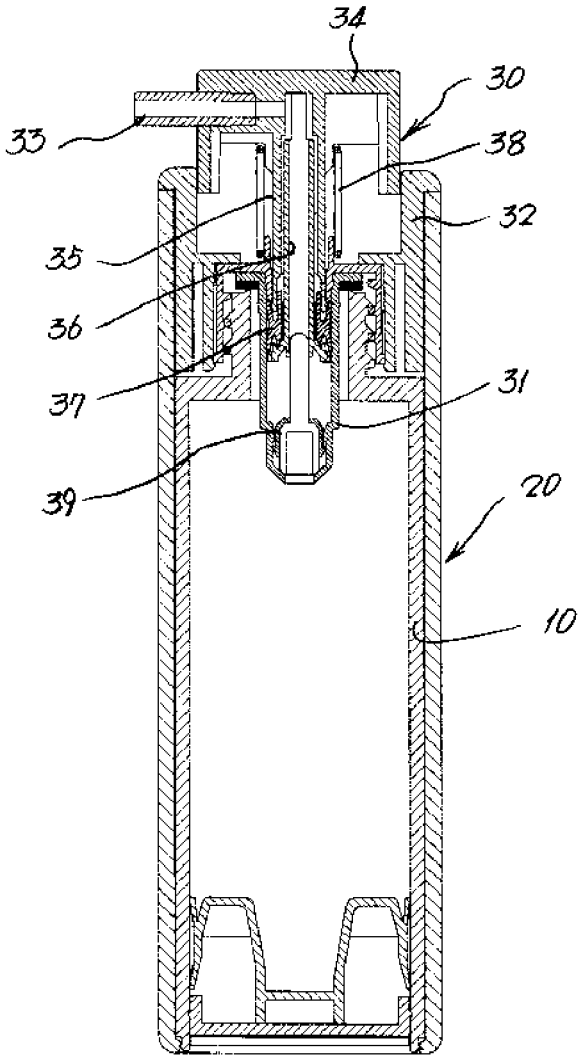
FIG. 5 is a cross sectional view illustrating a construction of a conventional pump-type cosmetics container.

FIG. 1 is a disassembled perspective view illustrating a pump-type cosmetics container according to a preferred embodiment of the present invention. FIG. 2 is a cross sectional view illustrating an initial state of a pump-type cosmetics container according to a preferred embodiment of the present invention. FIG. 3 is a cross sectional view illustrating a state that an end portion of a passing passage is opened as an opening and closing bracket of a pump-type cosmetic container opens according to a preferred embodiment of the present invention. FIG. 4 is a cross sectional view illustrating a state that a content is pumped out as a button of a pump-type cosmetics container is pressurized according to a preferred embodiment of the present invention.

The pump-type cosmetics container according to a preferred embodiment of the present invention comprises a container body 100, a pumping member 200, a locking member 300, an intermediate member 400 and an opening and closing bracket 500. There are further provided a cover 110, a first space 111, a second space 112, a third space 113, a suction part 210, a suction nozzle 220, a piston 230, a hollow part 310, an operation space 320, a locking protrusion 330, a sunk part 331, a moving passage 410, a rotation space 420, a rotation groove 430, an external operation bracket 440, an inner operation bracket 450, a rotary shaft 510, a control protrusion 520, an opening and closing part 530, a button 600, a protrusion part 610, a sealing bracket 700, a communicating hole 710, an engaging shoulder 711, a lower spring S1 and an upper spring S2.

The container body 100 is a member for storing contents. As shown in FIGS. 1 to 4, inside the container body 100 is provided a vacuum piston P which ascends by means of the operation of the pumping member 200 and maintains a vacuum state of the container body 100.

The top of the container body 10 is sealed by means of a cover 110, and at the top of the cove 110 are formed a first space 111, a second space 112 and a third space 113.

The first space 111 is a space in which the pumping member 200 is installed for thereby pumping out the contents stored in the container body 100, and the second space 112 is a space which supports the bottom of the lower spring S1 and seals the pumping member 200 to which is inserted a sealing bracket 700.

The third space 113 is a space surrounding the exterior of the operation space 320 for thereby accommodating the operation space of the locking member 300.

The pumping member 200 is installed in the first space 111 and sucks the contents of the container body 100 and moves them to the moving passage 410 of the intermediate member 400. As shown in FIGS. 1 to 4, the pumping member 200 comprises a suction part 210, a suction nozzle 220 and a piston 230.

The suction part 210 is installed at the bottom of the first space 111 and sucks the contents through the pumping operations of the suction nozzle 220 and the piston 230. The thusly sucked contents move through the suction nozzle 220 and through the communicating hole 710 and the hollow part 310 and to the moving passage 410.

The communicating hole 710 is a kind of through hole passing through the sealing bracket 700 from top to bottom, and the sealing bracket 700 seals the exterior of the pumping member 200, the bottom of which sealing bracket 700 being inserted into the second space 112.

As shown in FIGS. 1 to 4, the locking member 300 is engaged to the top of the container body 100. The locking member 300 comprises a hollow part 310, an operation space 320 and a locking protrusion 330.

The hollow part 310 is formed in the center of the locking member 300 and passes through the same from top to bottom, and the hollow part 310 communicates with the communicating hole 710 and the moving passage 410.

On the top of the locking member 300 is formed an operation space 320 in the upward and downward directions. The operation space 320 is a space into which an external operation bracket 440 is inserted and operates, and is accommodated in the third space 113.

At the top of the licking member 300 is provided a locking protrusion 330 which is equipped with the sunk part 331. The locking protrusion 330 allows the control protrusion 520 to be fixedly inserted into the sunk part 331 when the opening and closing bracket 500 is sealing the end portion of the moving passage 410, and when the moving passage 410 is opened, the opening and closing bracket 500 is tilted upward, and the locking protrusion 330 separates from the sunk part 331.

As shown in FIGS. 1 to 4, the intermediate member 400 is engaged to the top of the locking member 300 and is equipped with a passing passage 410 communicating with the hollow part 310 and the communicating hole 710. The contents pumped out by the pumping member 200 are inputted into the moving passage 410 and are discharged from the end portion.

As shown in FIGS. 2 to 4, on the top of the intermediate member 400 is provided a rotation space 420 and a rotation groove 430. At the inner surface of the intermediate member 400 is formed an internal operation bracket 450. Into the rotation space 420 is inserted the rotary shaft of the opening and closing bracket 500 thereby allowing the opening and closing bracket 500 to rotate.

In the rotation groove 430 is rotatable a control protrusion 520 which is connected to the rotary shaft 510 in a row. The rotation groove 430 and the rotation space 420 are formed continuously.

The internal operation bracket 450 passes through the hollow part 310 and is inserted into the communicating hole 710 and moves upward and downward. The internal operation bracket 450 can prevent contents from leaking into the hollow part 310.

As shown in FIGS. 1 to 4, the opening and closing bracket 500 comprises a rotary shaft 510, a control protrusion 520 and an opening and closing part 530. The opening and closing bracket 500 selectively opens and closes the end portion of the moving passage 410.

The rotary shaft 510 is inserted into the rotation space 420 and is rotatable therein. The control protrusion 520 is continuous from the rotary shaft 510. An end portion of the control protrusion 520 is fixedly inserted into the sunk part 331 of the locking protrusion 330 at a portion where the opening and closing bracket 500 is blocking the end portion of the moving passage 410. When the rotary shaft 5100 rotates, the end portion of the moving passage 410 is opened and tilted Here, the opening and closing part 530 is formed in a shape to cover the end portion of the moving passage 410. When the opening and closing bracket 500 rotates by the rotary shaft 510, the moving passage 410 is selectively opened or closed for thereby blocking foreign substances from entering into the moving passage 410.

It is preferred that on the top of the intermediate part 400 is provided a button 600. As shown in FIG. 3, the button 600 comes to operates in the upward and downward directions after the fixed control protrusion 520 is released from the locking protrusion 330 when the opening and closing bracket 500 rotates and is tilted.

When the user presses the button 600 down, the contents stored in the container body 100 can be discharged.

A protrusion part 610 is formed on an outer surface of the button 600. The protrusion 610 covers the top of the end portion of the moving passage 410.

The button 600 prevents the intermediate portion 400 from being exposed to the outside, for thereby making it look good.

The operations of the pump-type cosmetics container according to the present invention will be described.

FIG. 2 is a view illustrating an initial state of the pump-type cosmetics container according to a preferred embodiment of the present invention.

In the above mentioned initial state, the user rotates the opening and closing bracket 500 and opens the end portion of the moving passage and at the same time separates the control protrusion 520 from the sunk part 331, so the initial state changes into the state of FIG. 3.

In a state that the end portion of the moving passage 410 is open, the user pressurizes the button 600 downward, and the intermediate member 400 moves downward until the lower end portion of the internal operation bracket 450 reaches the engaging shoulder 711 provided in the interior of the communicating hole 710, the operations of which are called a first downward movement stage. In this state, since the pumping member 200 does not operate, elastic recovery force is not stored in the lower spring S1 and the upper spring S2.

In the first downward movement stage, when the user continues to press the button 600, as shown in Figure, the intermediate part 40 moves downward, and at the same time the internal operation bracket 450 moves downward along the inner wall of the communicating hole 710, and the external operation bracket 440 is inserted into the operation space 320 and moves downward.

Here, since the end portion of the internal operation bracket 450 is contacting with the engaging shoulder 711 provided in the interior of the communicating hole 710, the sealing bracket 700 moves downward by means of the press of the button 600, the operations of which are called a second downward movement stage.

When the sealing bracket 700 moves downward, elastic recovery force is stored in the lower spring S1 the lower end portion of which is supported, and at the same time the lower end portion is supported by the top of the sealing bracket 700, and elastic recovery force is stored in the upper spring S2 the upper end portion of which is supported by the inner wall of the intermediate member 400.

In addition, as the elastic force is stored in both the lower spring S1 and the upper spring S2, when the sealing bracket 700 moves downward, the pumping member 200 moves downward, and the contents stored in the container body 100 can be pumped out.

The contents pumped out by the pumping member 200 is discharged to the outside through the moving passage 410.

After the contents are pumped out by pressing the button 600 down, the intermediate member 400 and the sealing bracket 700 move back downward, and the intermediate member 400 and the sealing bracket 700 ascend up to the same position as the first downward movement stage.

Thereafter, the user rotates the tilted opening and closing bracket 500 and seals the end portion of the moving passage 410 with the aid of the opening and closing part 530. In order for the opening bracket 500 to close the end portion of the moving passage 410, the opening and closing bracket 500 is rotated in the direction opposite to the direction that the end portion of the moving passage 410 is opened.

After this, the control protrusion 520 presses the locking protrusion 330, and the end portion is inserted into the sunk part 331. As a counteraction with respect to the action that the locking protrusion 330 is pressed, the intermediate member 400 moves upward, and the inner pressure is formed in the interior of the communicating hole 710, and the contents remaining in the moving passage 410 is sucked back into the interior of the communicating hole 710.

When the end portion of the control protrusion 520 is inserted into the sunk part 331, the opening and closing part 530 comes to close the end portion of the moving passage 410 and at the same time prevents the intermediate member 400 from moving downward. The pump-type cosmetics container according to a preferred embodiment of the present invention remains in a locked state until the user tilts again the opening and closing bracket 500.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A pump-type cosmetics container, comprising:

a container body (100) which stores contents;

a pumping member (200) which pumps out the contents stored in the interior of the container body (100);

a locking member (300) engaged to the top of the container body (100) with a hollow part (310) formed in an upward and downward direction so that the contents pumped out by the pumping member (200) to pass through, an operation space (320) formed in an upward and downward direction, and a locking protrusion (330) protrudes from its top;

an intermediate member (400) is engaged to the top of the locking member (300) and is formed of a moving passage (410) communicating with the hollow part (310) for introducing in the contents pumped out by the pumping member (200), and an external operation bracket (440) is inserted into the operation space (320) and ascends and descends; and an opening and closing bracket (500) is engaged to the top of the intermediate member (400) and is rotatable and is formed of a control protrusion (520) which is disposed at the bottom and contacts with the locking protrusion 330 and allows a selective movement of the intermediate part (400) in an upward and downward direction; and wherein the locking protrusion (330) comprises a sunk part (331) formed at its top for the control protrusion (510) to be fixedly inserted into, and a slope surface (332) which is formed on the top of the locking protrusion (330) and is continuous from the sunk part (331) and has a curved surface, and when an external force is applied to the intermediate member (400), the opening and closing bracket (500) opens the end portion of the moving passage (410).

2. The container of claim 1, further comprising:

a button (600) including a protrusion part (610) which covers the top of the intermediate member (400) and selectively moves in an upward and downward direction when the opening and closing bracket (500) rotates, and the control protrusion (520) separates from the locking member (330) thereby covering the top of the end portion of the moving passage (410).

3. The container of claim 1, further comprising:

a cover (110) engages the top of the container body (100) and seals the container body (100) and includes:

a first space (111) in the center retains the pumping member (200);

a second space (112) located on the outer side of the first space (111) and comes into contact with the bottom of a lower spring S1; and a third space (113) located on outer side of the second space (112) and covers an exterior of the operation space (320);

a sealing bracket (700) is retained by second space (112) in order for the pumping member (200) to be sealed while covering the exterior of the pumping member 200, so its inner wall can be elastically supported by the top of the lower spring S1, the sealing bracket (700) including a communicating hole (710) communicating with the moving passage (410) and the hollow part 310, and an engaging shoulder (711) disposed in the interior of the communicating hole;

an internal operation bracket (450) which protrudes downward from the inner side surface of the intermediate member (400) and passes through the hollow part (310) and is inserted into the communicating hole (710) and moves the sealing bracket (500) downward when it comes into contact with the engaging shoulder (711); and an upper spring S2 is retained by an outer surface of the internal operation bracket (450), the bottom of the upper spring S2 being supported by the top of the sealing bracket (700), the top of the same being supported by the inner wall of the intermediate member (400).

4. The container of claim 3, wherein after the pumping of the pumping member (200) is completed, when the sealing bracket (700) and the intermediate member (400) ascend by means of an elastic recovery force of the lower spring S1 and the upper spring S2, the opening and closing bracket (500) is rotated, and the intermediate member (400) ascends by a counteraction formed as the control protrusion (520) presses the locking protrusion (330), and the contents remaining in the moving passage (410) is sucked back into the communicating hole (710).

5. The container of claim 1, further comprising:

a rotation space (420) located upon on the top of the intermediate member;

a rotation groove (430) communicates with the rotation space (420) and into which the control protrusion (520) is inserted and is rotatable; and a rotary shaft (510) is located within into the rotation space (420) and is rotatable in a state that it is connected with the control protrusion (520).

6. The container of claim 5, wherein the opening and closing bracket (500) comprises an opening and closing part (530) which selectively opens and closes the end portion of the moving passage (410) when it rotates by means of the rotary shaft (510).

* * * * *